US006848684B2

(12) United States Patent
Fortin et al.

(10) Patent No.: US 6,848,684 B2
(45) Date of Patent: Feb. 1, 2005

(54) WORKBENCH HAVING PLASTIC CLAMPING WORK SURFACE

(75) Inventors: Marc A. Fortin, Brockville (CA); John Bryan Mason, Brockville (CA); Mike G. Sirois, Ottawa (CA); Robert D. Watters, Ottawa (CA); Clifford D. Read, Carp (CA)

(73) Assignee: Black & Decker Inc., Newark, DE (US)

( * ) Notice: Subject to any disclaimer, the term of this patent is extended or adjusted under 35 U.S.C. 154(b) by 18 days.

(21) Appl. No.: 10/245,173

(22) Filed: Sep. 17, 2002

(65) Prior Publication Data

US 2004/0051224 A1 Mar. 18, 2004

(51) Int. Cl.[7] ..... B25B 1/02

(52) U.S. Cl. ..... 269/139; 269/286; 269/16; 269/900; 269/901; 269/17; 269/220

(58) Field of Search ..... 269/17, 139, 16, 269/15, 901, 900, 257, 268, 286, 219–220, 244; 144/285, 286 R, 287; 108/131, 129, 128, 126, 121, 115

(56) References Cited

U.S. PATENT DOCUMENTS

| | | | | |
|---|---|---|---|---|
| 2,449,492 A | | 9/1948 | Long | |
| 3,349,728 A | | 10/1967 | Barecki et al. | |
| D210,360 S | | 3/1968 | Gerakos | |
| 3,615,087 A | | 10/1971 | Hickman | |
| 3,676,279 A | | 7/1972 | Beaver | |
| D225,291 S | | 12/1972 | Kastner | |
| D230,801 S | | 3/1974 | Hickman et al. | |
| 3,841,619 A | | 10/1974 | Hickman | |
| 4,034,684 A | | 7/1977 | Carson et al. | |
| 4,061,305 A | | 12/1977 | Beekenkamp | |
| 4,061,323 A | | 12/1977 | Beekenkamp | |
| 4,065,115 A | * | 12/1977 | Popeil et al. | 269/16 |
| 4,073,484 A | | 2/1978 | Beekenkamp | |
| 4,076,229 A | | 2/1978 | Hickman | |
| D250,079 S | | 10/1978 | Hickman et al. | |
| 4,127,260 A | | 11/1978 | Hickman | |
| 4,140,309 A | | 2/1979 | Hickman | |
| 4,154,435 A | | 5/1979 | Alessio | |
| 4,155,386 A | | 5/1979 | Alessio | |
| 4,157,174 A | | 6/1979 | Hickman et al. | |
| 4,159,821 A | | 7/1979 | Hickman | |
| D253,212 S | | 10/1979 | Maruscak et al. | |
| D256,533 S | | 8/1980 | Alessio | |
| 4,216,949 A | | 8/1980 | Hickman | |
| D256,641 S | | 9/1980 | Wilson et al. | |
| 4,223,881 A | | 9/1980 | Hickman | |
| 4,236,599 A | | 12/1980 | Luff et al. | |
| 4,243,212 A | * | 1/1981 | Bunyea et al. | 269/139 |
| 4,248,411 A | | 2/1981 | Wagster et al. | |

(List continued on next page.)

FOREIGN PATENT DOCUMENTS

| | | |
|---|---|---|
| EP | WO 00/53375 | 3/2000 |

*Primary Examiner*—Robert C. Watson
(74) *Attorney, Agent, or Firm*—Harness, Dickey & Pierce, P.L.C.

(57) ABSTRACT

A portable workbench includes a top structure, a support structure and a collapsible frame. The top structure includes top members lying in a common plane. The top members include upper working surfaces and lower supporting surfaces. The lower supporting surfaces include a plurality of rib portions formed thereon. The top members further include longitudinally extending opposed side portions defining clamping surfaces. A linkage mechanism cooperates with the frame to actuate the workbench between an expanded working position and a collapsed transport position. A lever releasably cooperates with the frame to maintain the workbench in a locked expanded position.

16 Claims, 9 Drawing Sheets

U.S. PATENT DOCUMENTS 4,252,304 A 2/1981 Pettican
4,256,294 A 3/1981 Hickman et al.
4,276,955 A 7/1981 Hickman
4,278,243 A * 7/1981 Alessio ..... 269/139
4,291,869 A 9/1981 Hickman
4,294,441 A * 10/1981 O'Banion et al. ..... 269/139
4,310,150 A 1/1982 Andrews
4,555,099 A 11/1985 Hilton
4,625,951 A 12/1986 Yang
4,726,556 A 2/1988 Weir
D296,143 S 6/1988 Bettess
4,951,576 A 8/1990 Cobos et al.
5,067,535 A 11/1991 Wolff
D333,390 S 2/1993 McCauley
D335,786 S 5/1993 Garvey et al.
5,351,730 A 10/1994 Lewellen et al.
5,417,168 A 5/1995 Soper
5,443,020 A 8/1995 Price
5,595,228 A 1/1997 Meisner et al.
5,603,491 A 2/1997 Murrell
5,694,865 A 12/1997 Raab
5,732,637 A 3/1998 Raab
D409,016 S 5/1999 Haley et al.
5,901,763 A 5/1999 You
5,931,488 A 8/1999 Graziano et al.
6,019,050 A 2/2000 Ranta
D435,367 S 12/2000 Tzeng
D436,268 S 1/2001 Ko
D448,200 S 9/2001 Sagol
6,286,824 B1 * 9/2001 Sagol ..... 269/900
D449,470 S 10/2001 Morrow
6,318,713 B1 * 11/2001 Levi ..... 269/139

* cited by examiner

WORKBENCH HAVING PLASTIC CLAMPING WORK SURFACE

FIELD OF THE INVENTION

The present invention relates to a workbench and more specifically to a collapsible portable workbench having a plastic work surface.

BACKGROUND OF THE INVENTION

Workbenches incorporating a workpiece clamping device provide a convenient structure to secure a workpiece while performing a tooling operation. This type of clamping workbench generally includes a pair of top members, one of which is fixed to a supporting structure, while the other is adjustable along the supporting structure toward and away from the first one of the top members by a screw-type handle translation device.

Certain workbenches of this type include top members comprised of wood, metal or plastic material. Often, workbenches comprising wood or metal top members are cumbersome and awkward to manipulate. Some workbenches incorporating plastic top members, while having reduced weight over wood and metal counterparts, lack sufficient rigidity and durability.

While the above described arrangement has proven to be successful, a need has arisen for a more simple portable workbench incorporating a plastic work surface which is light in weight and easy to manipulate between an expanded working position and a collapsed storage position.

SUMMARY OF THE INVENTION

A portable workbench includes a plastic top structure having a pair of mutually adjacent top members lying in a common plane. The top members have an upper working surface and a lower supporting surface. The supporting surface includes a plurality of rib sections formed thereon. The top members further include longitudinally extending opposed side portions defining clamping surfaces.

A support structure supports the top structure. The support structure includes a clamping device for selectively transversing at least one of the top members toward the other of the top members to provide for clamping of a workpiece therebetween.

A collapsible frame is connected to the support structure. The frame is movable between an expanded position and a collapsed position. The top members form a substantially parallel relationship with ground in the expanded position and form a substantially perpendicular relationship with the ground in the collapsed position.

In other features, the top members further include outboard edges connected to the working surface by a radial contour. The top members are comprised of injection molded polypropylene. The top members include apertures formed therethrough defining handles. Cylindrical passages are formed through the top members.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
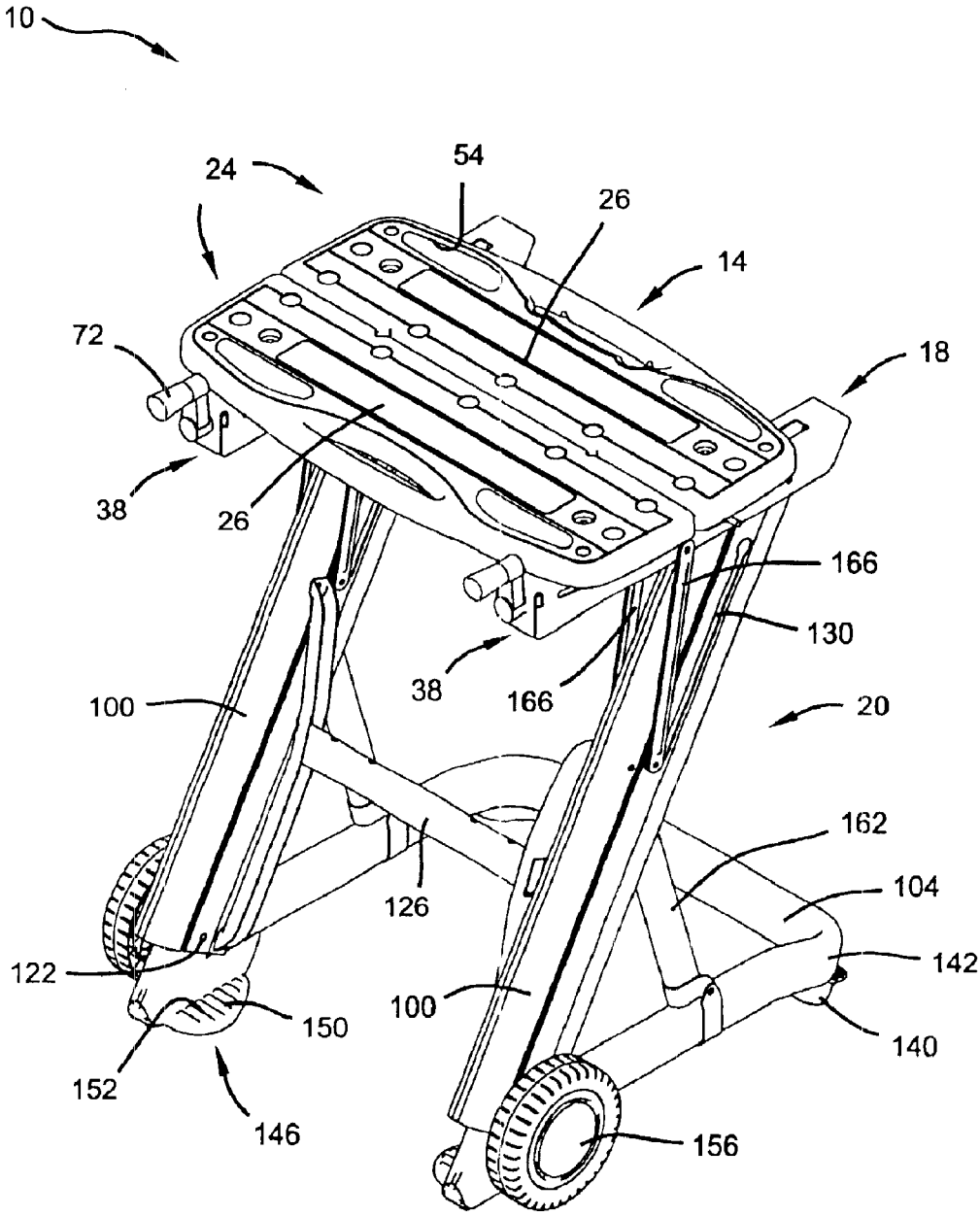
FIG. 1 is a front perspective view of the workbench according to the present invention shown in an expanded position.
Figure 2:
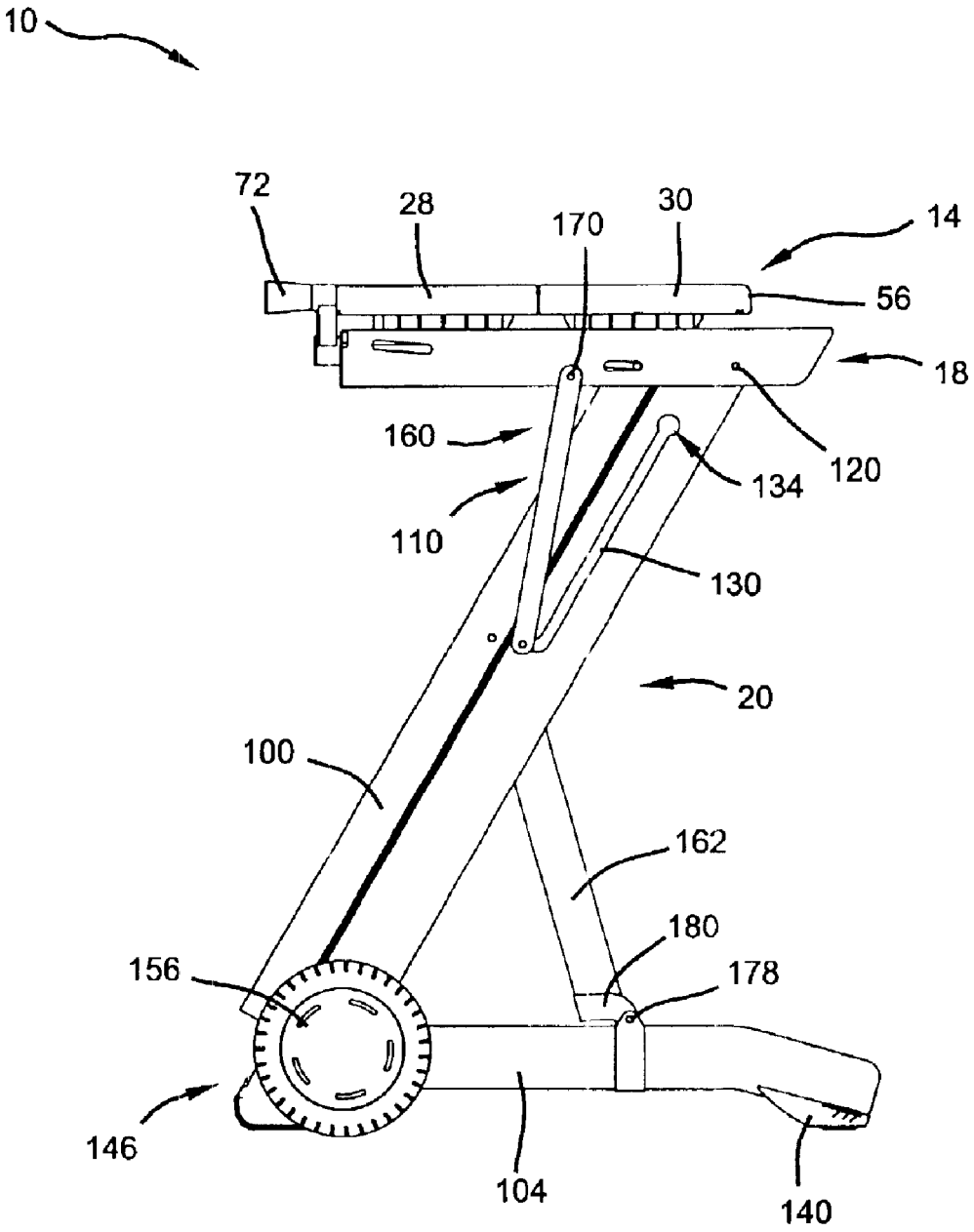
FIG. 2 is a side view of the workbench shown in an expanded position.
Figure 3:
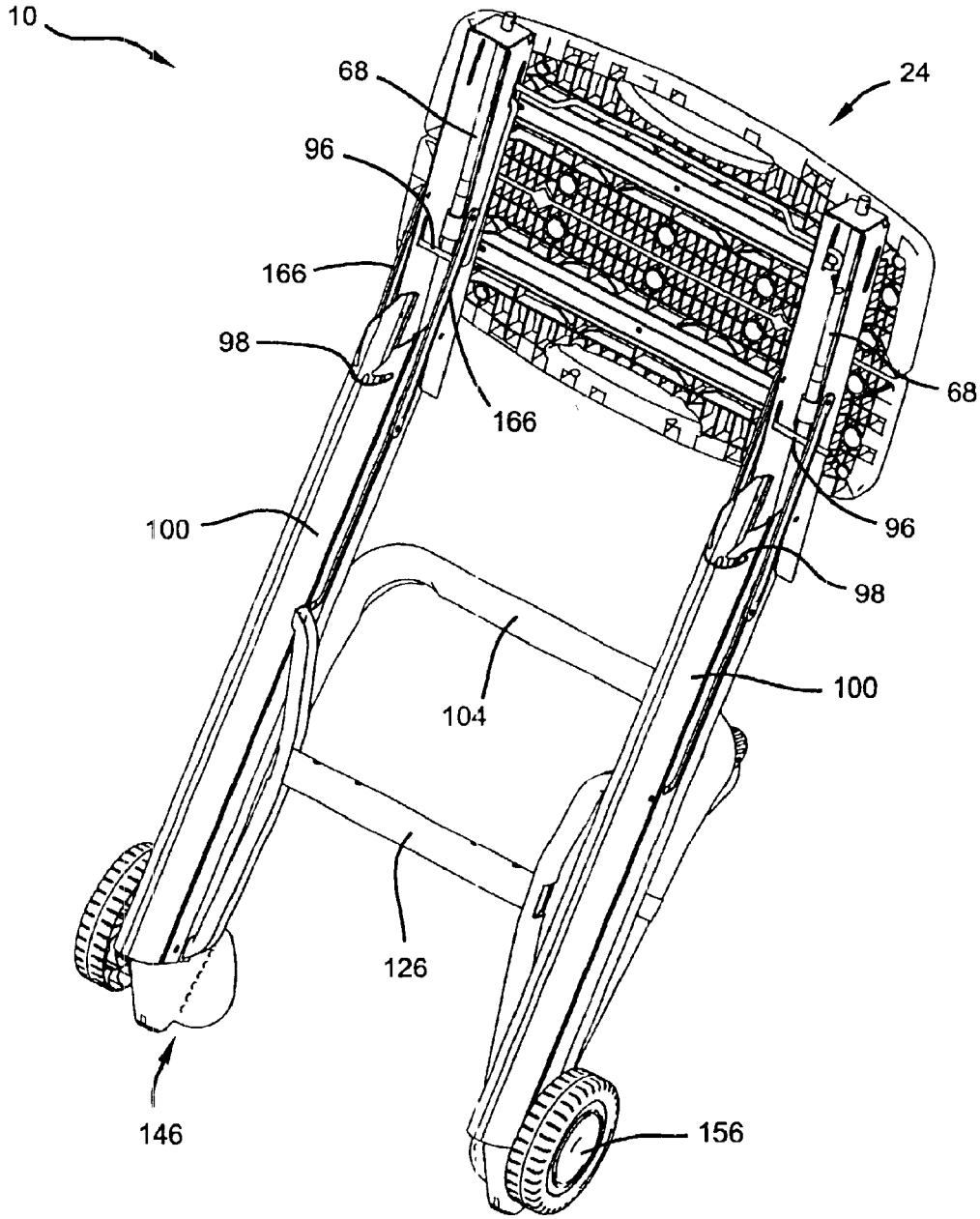
FIG. 3 is a rear perspective view of the workbench shown in a collapsed position.

With initial reference to FIGS. 1–4, a portable workbench 10 according to the present invention is shown. Workbench 10 generally includes a top structure 14, a support structure 18 and a collapsible frame 20. Workbench 10 is movable between an expanded position, as shown in FIG. 1, and a collapsed position, as shown in FIG. 3.

Figure 4:
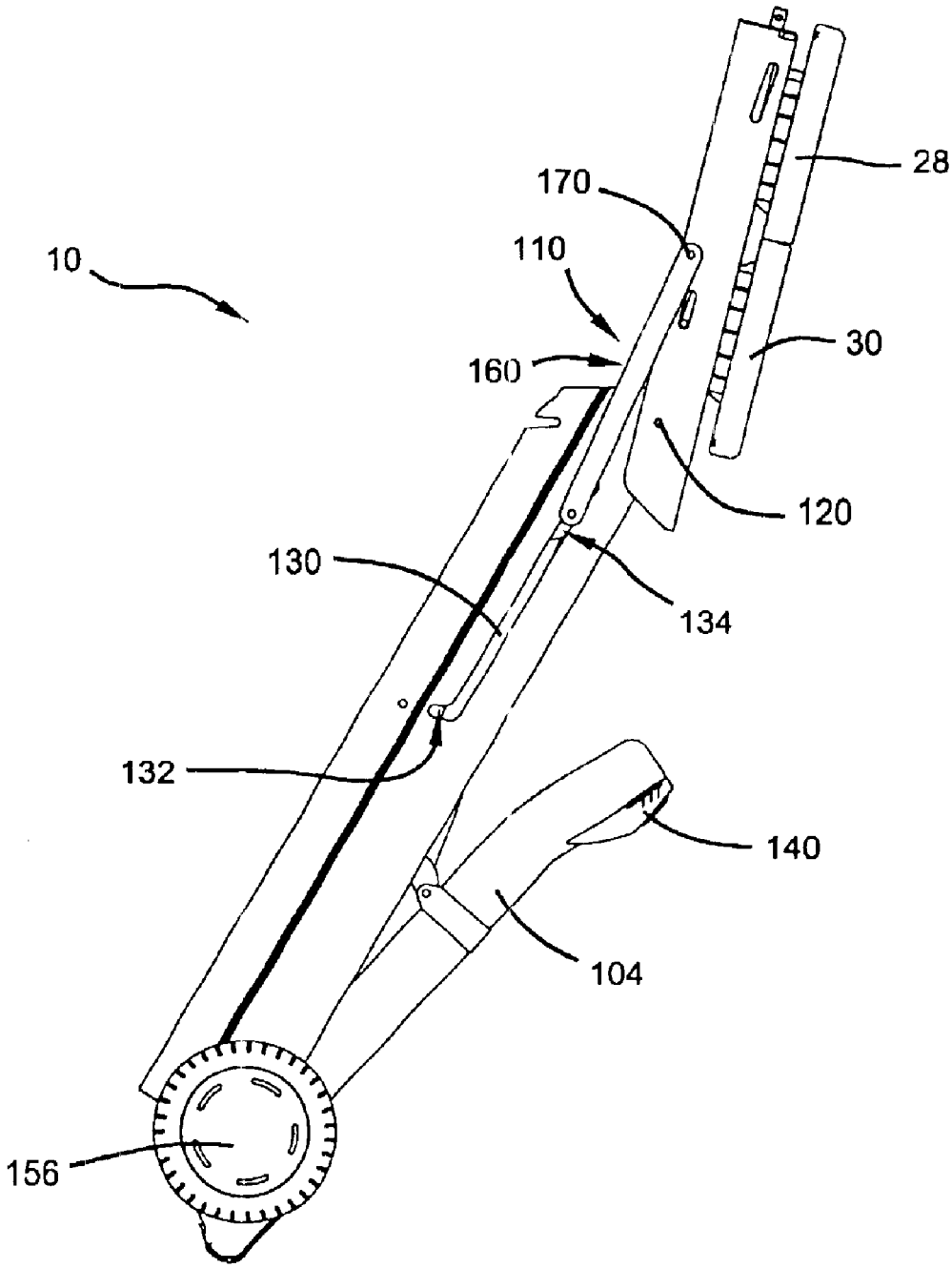
FIG. 4 is a side view of the workbench shown in a collapsed position.
Figure 5:
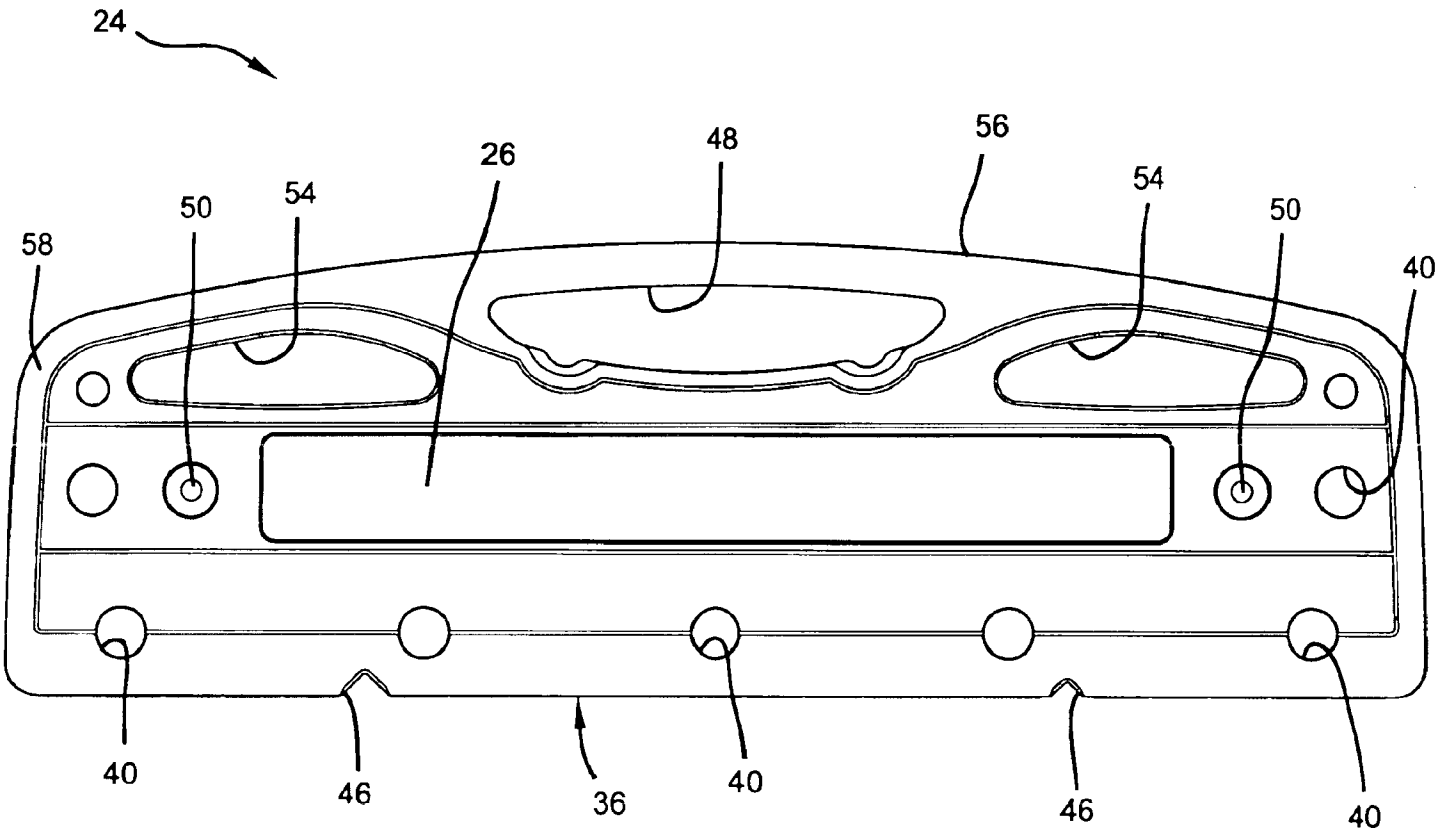
FIG. 5 is a top view of a top member of the workbench.
Figure 6:
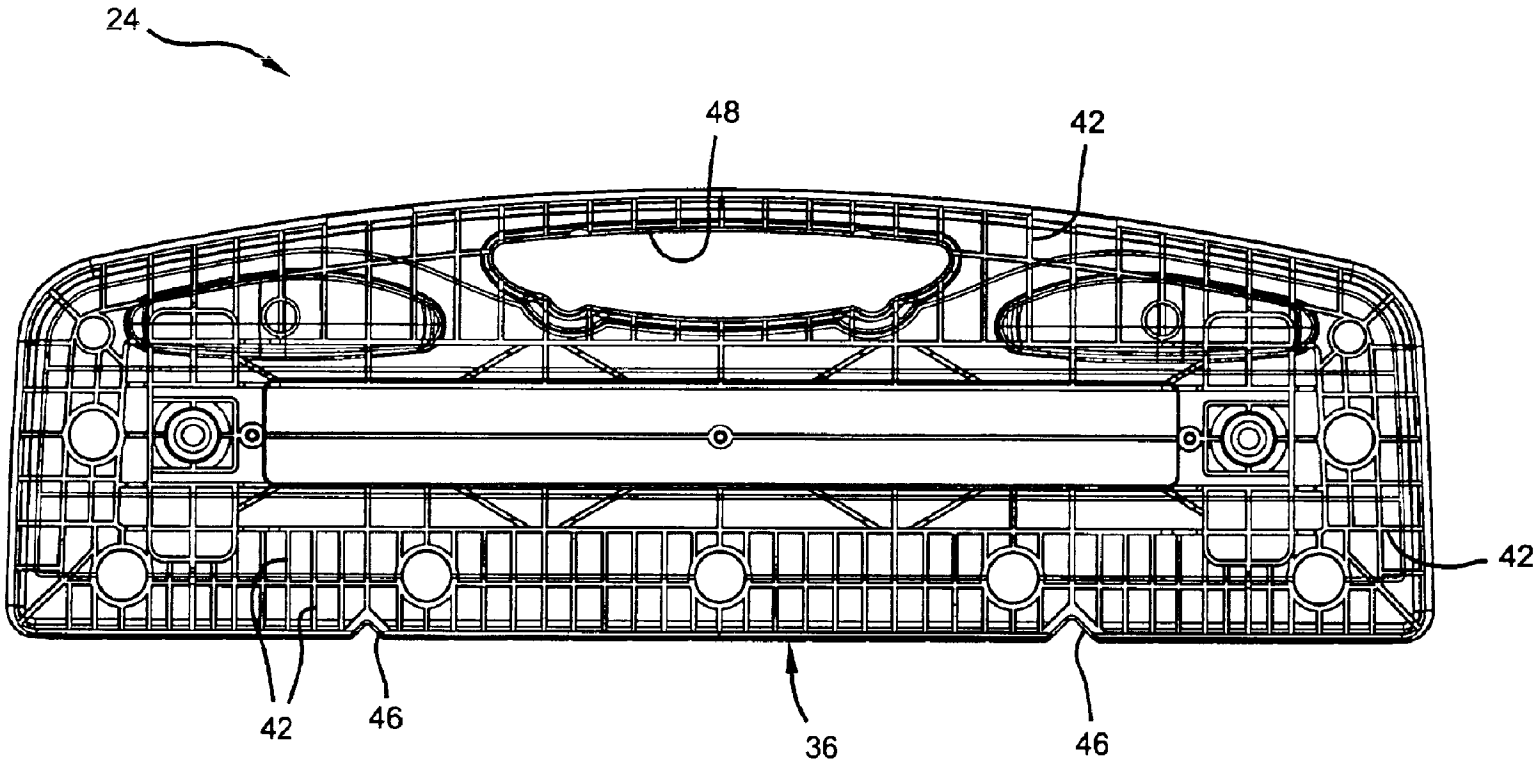
FIG. 6 is a bottom view of a top member of the workbench.

With continued reference to FIGS. 1–4 and further reference to FIGS. 5 and 6, top structure 14 will be described in greater detail. Top structure 14 includes a pair of elongated mutually adjacent top members 24 including upper work supporting surfaces 26 lying generally in a common plane. Top members 24 are further defined by stationary member 28 and translating member 30. Top members 24 include longitudinally extending opposed side portions 36 defining clamping surfaces. As will be described in greater detail, translating member 30 is adjustable toward and away from stationary member 28 by way of a screw-type clamping device 38.

Top members 24 are preferably made of injection molded polypropylene. Each top member 24 includes molded thereon a plurality of bore sections 40 for durability. Bore sections 40 also accept accessory pegs (not shown) which increase the clamping range for larger workpieces. The underside of each top member 24 (FIG. 6) includes a plurality of rib sections 42 formed thereon for increased stability. Rib sections 42 are shown generally as rectangular portions but may also be arranged in other geometric shapes such as hexagonal for example. Opposing clamping detents 46 are formed along each opposed side portion 36. Clamping detents 46 provide a gripping function to locate a workpiece in a fixed location between the clamping surface 36 or alternatively are arranged to accommodate extending portions of a workpiece. A handle 48 is integrally formed on an outer edge of each top member 24. A pair of counter bores 50 are arranged on each top member 24 for accepting fasteners to couple support structure 18 thereto.

Recessed portions 54 arranged on the outer corners of each top member 26 provide convenient locating areas for small parts such as fasteners and the like. The transition between working surfaces 26 and a peripheral edge 56 of top members 26 is defined by a radial contour 58. Radial contour 58 provides increased stability to the top structure 14 as a whole and is also accommodating to the touch.

Figure 7:
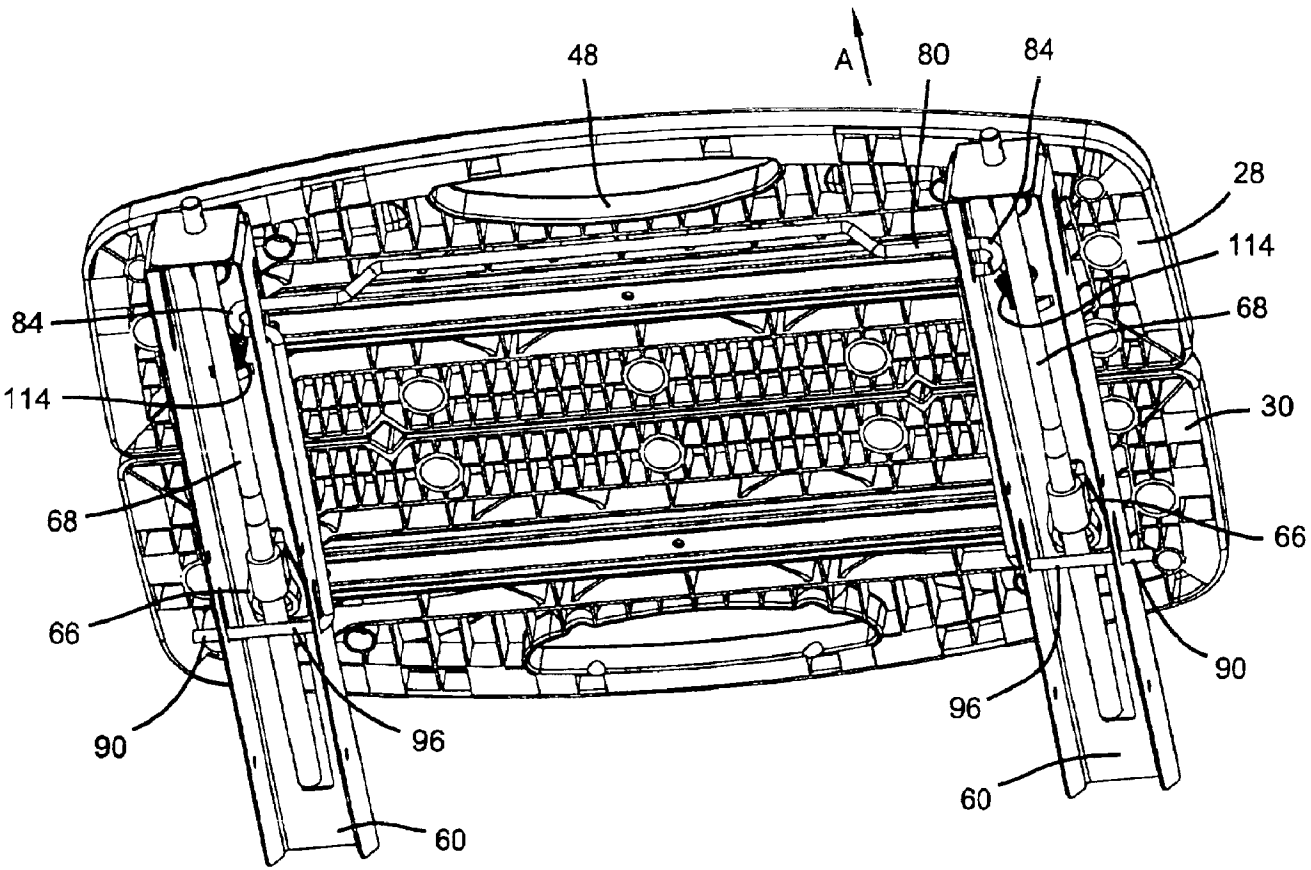
FIG. 7 is a bottom perspective view of the top structure and support structure of the workbench.
Figure 8:
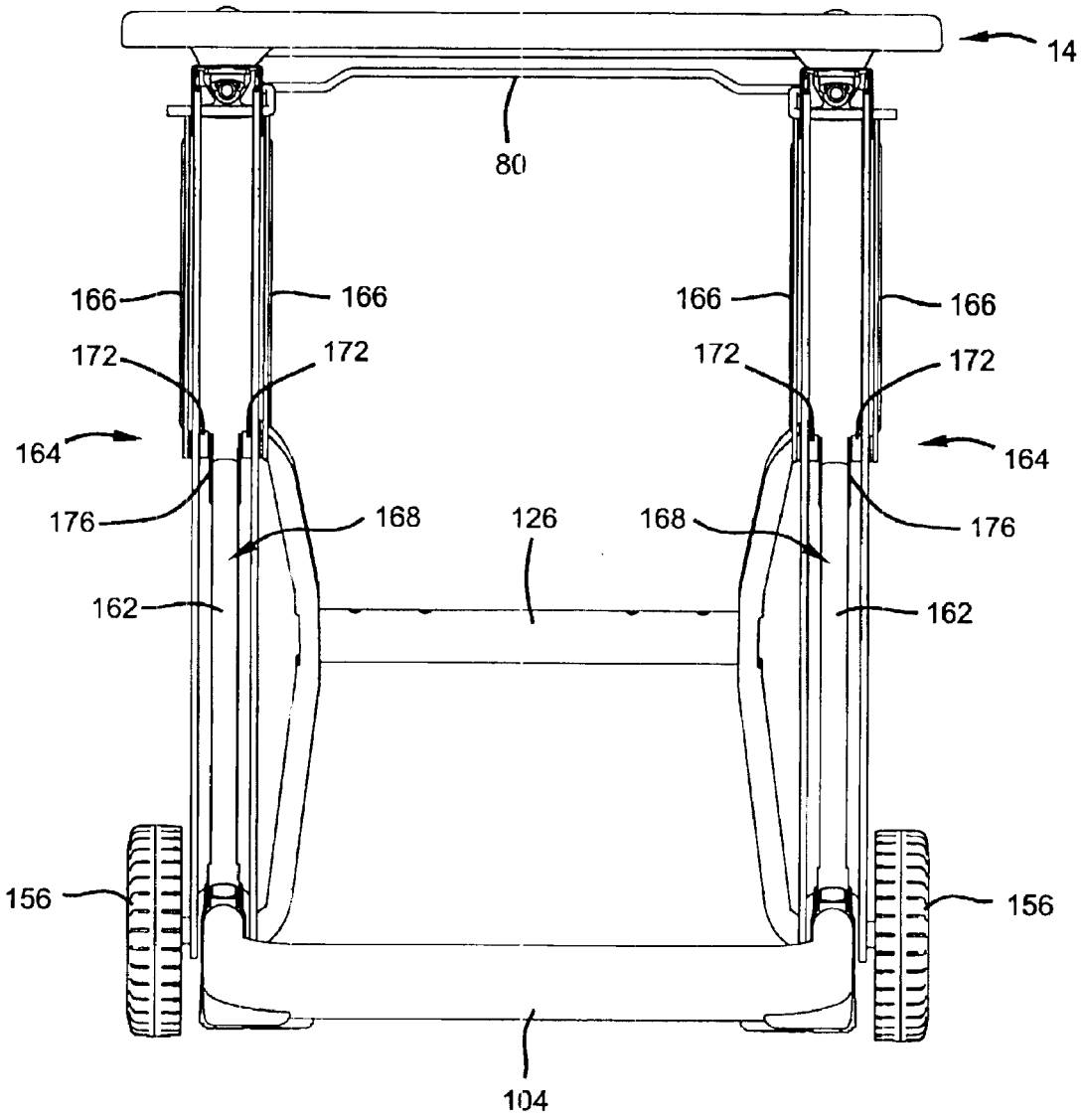
FIG. 8 is a rear view of the workbench in an expanded position.
Figure 9:
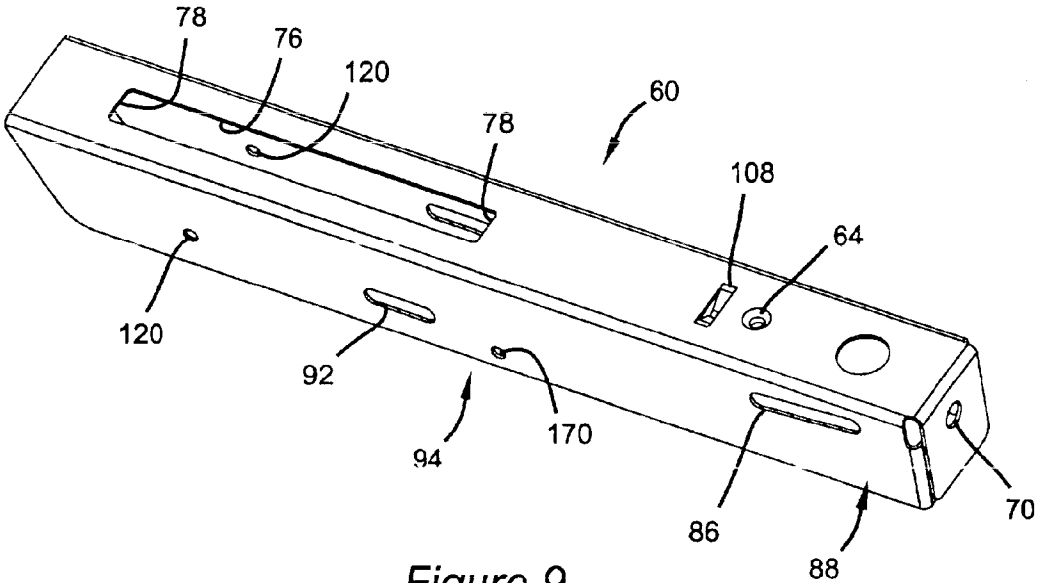
FIG. 9 is a perspective view of a support member.

Turning now to FIGS. 7 and 9, support structure 18 will be described in greater detail. Support structure 18 includes a pair of generally u-shaped laterally disposed support members 60. Stationary member 28 is coupled through blind bores 50 to support members 60 at mounting bores 64 with conventional fasteners (not shown). Translating member 30 is coupled through respective blind bores 50 to mounting collars 66. Mounting collars 66 are threadably journalled around respective adjusting rods 68. Collars 66 are guided along threads formed along adjusting rods 68 upon rotation of the adjusting rods 68. Adjusting rods 68 extend through a front passage 70 incorporated on each support member 60 and terminate at handles 72. Adjusting rods 68 cooperate with collars 66 to translate rotational movement of handles 72 into lateral movement of translating member 30 along support members 60. In this way, cutout portion 76 accommodates the linear movement of collar 66 therealong. Outer edges 78 of cutout portion 76 bound collars 66 and define the maximum travel of translating member 30. It will be appreciated that other mechanical arrangements may be employed to translate top members 24 relative to each other in a clamping arrangement.

Figure 10:
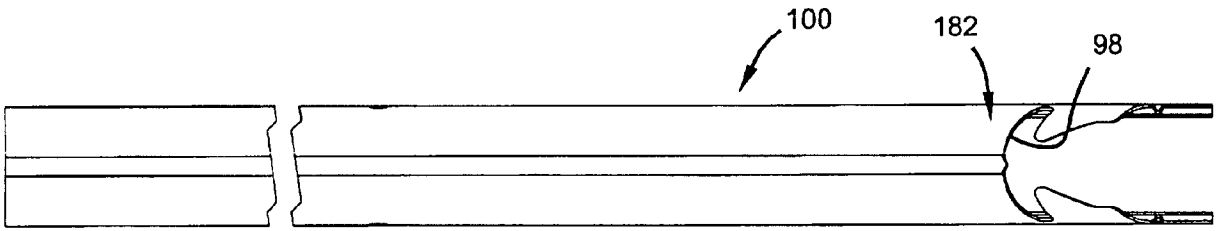
FIG. 10 is a plan view of a leg incorporated in the collapsible frame.

A handle or lever 80 is slidably coupled between support members 60 for releasing the collapsible frame 20 from an expanded position to a collapsed position. Looped portions 84 are guided along opposing slots 86 arranged along a front portion 88 of support members 60. Similarly, the terminal ends 90 of lever 80 extend through and are guided along slots 92 incorporated on a central portion 94 of support members 60. As will be described in greater detail with respect to FIG. 10, latch portion 96 of lever 80 is urged toward engagement with notches 98 formed on legs 100 by biasing members 114. The cooperation of latch portions 96 with notches 98 maintains workbench 10 in a stable expanded position. Biasing members 114 are coupled on a first end to loop portion 84 of handle 80 and a mounting extension 108 of support members 60 on a second end. Support members 60 are preferably made of a rigid material such as roll formed metal.

With reference now to all Figures, collapsible frame 20 incorporating linkage mechanism 110 will be described. Frame 20 includes a pair of legs 100 pivotally extending between respective support members 18 and a support base 104. Legs 100 are connected on upper ends to respective support members 18 at support member pivot points 120. Similarly legs 100 are connected on lower ends to respective base support pivot points 122. In an expanded working position (FIGS. 1 and 2), legs 100 separate top structure 14 and support base 104 into a parallel, spaced apart relationship. Legs 100 are laterally supported by cross brace 126. Cross brace 126 is shown having a generally u-shaped geometry however alternative arrangements may be employed. A slot 130 is incorporated on each leg 100 to guide linkage mechanism 110 between expanded and collapsed positions. Slots 130 are preferably arranged in a J-shaped orientation whereby linkage mechanism 110 cooperates with a curved lower section 132 of slots 130 in an expanded position and cooperates with a generally linear upper section 134 of slots 130 in a collapsed position.

Support base 104 includes ground engaging support pads 140 secured on outer corners 142. Ground engaging feet 146 extend at the leg, base intersection. Feet 146 each include an inwardly extending flange 150 providing added ground gripping capability. Each flange 150 includes gripping ridges 152 formed along an upper edge. In this way, a user may step on one or both flange 150 to provide increased workbench stability. Wheels 156 are rotatably coupled to legs 100 at the leg, base intersection. Wheels 156 are arranged such that they are laterally displaced away from the ground when workbench 10 is in an expanded position. When workbench 10 is in a collapsed position and tilted toward wheels 156 at an angle with the ground, wheels 156 engage the ground to facilitate movement therealong. When workbench 10 is in a collapsed position and tilted away from wheels 156, the wheels 156 are precluded from ground engagement. In this way, workbench 10 may be tilted against a wall in a stable position with feet engaging the ground (FIG. 4).

Linkage mechanism 110 includes a pair of link members 160 operatively connecting support members 60 and legs 100. In addition, linkage mechanism 110 includes a pair of connecting members 162 operatively connecting support base 104 and legs 100. Each link member 160 generally includes an inboard and outboard slide arm 166. Slide arms 166 are coupled on a first end for pivotal movement to respective support members 60 at inboard and outboard pivot points 170. Slide arms 166 are coupled on a second end to respective inboard and outboard posts 172. Posts 172 extend through and are translatable along slots 130 formed along legs 100. Posts 172 are hingedly interconnected to first ends 164 of respective connecting members 162 by way of links 176. Second ends 168 of connecting members 162 are pivotally secured to link pivot joints 178 incorporated at mounting flanges 180 extending from support base 104.

The operation of linkage mechanism 110 will now be described in the context of moving the workbench 10 from an expanded position (FIG. 1) to a collapsed position (FIG. 3). First, a user grasps lever 80 extending under stationary member 28 and actuates lever 80 in a direction toward the user defining a release direction (arrow A, FIG. 7). In a first method of operation, the user may place a first hand on a portion of the peripheral edge of stationary top member 28 while actuating lever 80 with the other hand. In a second method of operation, the efficiency of linkage mechanism 110 allows a user to manipulate workbench 10 from an expanded position to a collapsed position with one hand. Accordingly, a user would position a thumb around peripheral edge 56 of stationary member 28 and pull lever 80 in the release direction with the remaining fingers of the same hand.

Movement of lever 80 in the release direction disengages latch portions 96 of lever 80 from notches 98 on legs 100. The user subsequently rotates work surface 26 upward causing support members 60 to rotate about legs 100 at support member pivot points 120 (clockwise as viewed from FIG. 2). Rotational movement of support members 60 about pivot points 120 urges link members 166 upward along slots 130. Translation of link members 166 along slots 130 concurrently pulls the first ends 164 of connecting members 162 along the same path by way of the post and link arrangement. Translation of first ends 164 of connecting members 162 causes the second ends 168 of connecting members 162 to pivot about link pivot joints 178. Such movement urges support base 104 to rotate toward legs 100 about base pivot joints 122 (counter-clockwise as viewed from FIG. 2). Rotation of top structure 14 continues until posts 172 engage terminal upper end 134 of slots 130.

To return the workbench 10 to an expanded position from a collapsed position a user rotates top structure 14 counter-clockwise as viewed from FIG. 4. Concurrently, link members 166 follow slot 130 toward J-section 132. Top structure 14 and support base 104 expand to the generally parallel relationship upon rotation about respective support member and base pivot points 120, 122. Each latch 96 of lever 80 slides along an outer front surface 182 of leg 100 near notch 98 until engaging notch 98. Biasing members 114 subsequently urge each latch 96 into notch 98 thereby achieving a locked expanded position.

Those skilled in the art can now appreciate from the foregoing description that the broad teachings of the present invention can be implemented in a variety of forms. For example, the workbench disclosed herein is described having slidable link members cooperating on each leg of the collapsible frame. It is envisioned however that the workbench may alternatively incorporate a single linkage cooperating with one leg while reaching similar results. Therefore, while this invention has been described in connection with particular examples thereof, the true scope of the invention should not be so limited since other modifications will become apparent to the skilled practitioner upon a study of the drawings, the specification and the following claims.

What is claimed is:

1. A portable workbench comprising:

a plastic top structure having a pair of mutually adjacent top members lying generally in a common plane, said top members having an upper working surface and a lower supporting surface, said supporting surface including a plurality of rib sections formed thereon, said top members further including longitudinally extending opposed side portions defining clamping surfaces and oppositely extending peripheral edge portions, said peripheral edge portions defining an arcuate contour wherein said top members each define apertures having a generally oval shape defining an arcuate outboard contour substantially equivalent to and offset from said peripheral edge portions, said apertures defining handles for facilitating manipulation of the workbench;

a support structure supporting said top structure, said support structure including a clamping device for selectively transversing at least one of said top members toward the other of said top members to provide for clamping of a workpiece therebetween; and a collapsible frame connected to said support structure, said frame movable between an expanded position and a collapsed position, said top members forming a substantially parallel relationship with ground in said expanded position and forming a substantially perpendicular relationship with said ground in said collapsed position.

2. The portable workbench of claim 1 wherein said top members further comprise a radiused lip extending around an outer perimeter.

3. The portable workbench of claim 1 wherein said top members are comprised of injection molded polypropylene.

4. The portable workbench of claim 3 wherein said top members include a plurality of cylindrical passages molded therethrough.

5. The portable workbench of claim 3 wherein at least one recessed portion is molded on said working surface of said top members.

6. The portable workbench of claim 1 wherein said clamping surfaces include at least a pair of opposing clamping detents formed thereon.

7. A workbench comprising:

a plastic top structure having a pair of mutually adjacent top members lying generally in a common plane, said top members having an upper working surface and a lower supporting surface, said supporting surface including a plurality of rib sections formed thereon, said top members further including radially extending outboard edges and longitudinally extending opposing inboard edges, said inboard edges defining clamping surfaces, said outboard edges defining an arcuate contour, wherein said top members each define apertures having a generally oval shape defining an arcuate outboard contour substantially equivalent to and offset from said outboard edges, said apertures defining handles for facilitating manipulation of the workbench;

a clamping device coupled to said top structure, said clamping device selectively transversing at least one of said top members toward the other of said top members to provide for clamping of a workpiece therebetween; and a collapsible frame connected to said top structure and moveable between an expanded working position and a collapsed storage position, said top members forming a substantially parallel relationship with ground in said expanded position and forming a substantially perpendicular relationship with said ground in said collapsed position.

8. The portable workbench of claim 7 wherein said top members are comprised of injection molded polypropylene.

9. The portable workbench of claim 7 wherein said top members include a plurality of cylindrical passages molded therethrough.

10. The portable workbench of claim 7 wherein at least one recessed portion is molded on said working surface of said top members.

11. The portable workbench of claim 7 wherein said clamping surfaces include at least a pair of opposing clamping detents formed thereon.

12. A workbench comprising:

a plastic top structure having a pair of mutually adjacent top members lying generally in a common plane, said top members having an upper working surface and a lower supporting surface, said supporting surface including a plurality of rib sections formed thereon, said top members further including radially extending outboard edges and longitudinally extending opposing inboard edges, said inboard edges defining clamping surfaces, said outboard edges connected to said working surface by a radial contour, said top members including a plurality of cylindrical passages formed therethrough, wherein said top members each define apertures having a generally oval shape defining an arcuate outboard contour substantially equivalent to and offset from said outboard edges, said apertures defining handles for facilitating manipulation of the workbench;

a clamping device coupled to said top structure, said clamping device selectively transversing at least one of said top members toward the other of said top members to provide for clamping of a workpiece therebetween; and a collapsible frame connected to said top structure and moveable between an expanded working position and a collapsed storage position, said top members forming a substantially parallel relationship with ground in said expanded position and forming a substantially perpendicular relationship with said ground in said collapsed position.

13. The portable workbench of claim 12 wherein said top members are comprised of injection molded polypropylene.

14. The portable workbench of claim 12 wherein said top members further include apertures formed therethrough defining handles.

15. The portable workbench of claim 12 wherein at least one recessed portion is molded on said working surface of said top members.

16. The portable workbench of claim 12 wherein said clamping surfaces include at least a pair of opposing clamping detents formed thereon.

* * * * *